United States Patent [19]

Vail

[11] 4,448,543

[45] May 15, 1984

[54] TIME-OF-DAY CLOCK HAVING A TEMPERATURE COMPENSATED LOW POWER FREQUENCY SOURCE

[75] Inventor: David K. Vail, Palm Bay, Fla.

[73] Assignee: Rockwell International Corporation, El Segundo, Calif.

[21] Appl. No.: 458,419

[22] Filed: Jan. 17, 1983

[51] Int. Cl.[3] ..... G04B 17/20; G04B 1/00

[52] U.S. Cl. ..... 368/202; 368/204

[58] Field of Search ..... 368/200–204; 328/155

[56] References Cited

U.S. PATENT DOCUMENTS

| | | | |
|---|---|---|---|
| Re. 31,402 | 10/1983 | Hashimoto et al. | 368/202 |
| 4,286,263 | 8/1981 | Lindberg | 368/64 |
| 4,305,041 | 12/1981 | Ferking | 328/155 |
| 4,340,808 | 7/1982 | Donohoo | 368/96 |

*Primary Examiner*—Bernard Roskoski

*Attorney, Agent, or Firm*—Edward A. Gerlaugh; George A. Montanye; H. Fredrick Hamann

[57] ABSTRACT

An electronic time-of-day clock having a low-power time source and compensation circuits selectively operable responsive to pulses output from the low-power time source when system primary power is off or disabled, and responsive to a relatively highly accurate time-pulse generator when primary power is enabled. The time-of-day clock compensates continuously in real-time for errors in the output of the low-power time source caused by variations in the ambient temperature of the device; when primary power is enabled, the output of the low-power time source is further compensated by comparing the output thereof with the output of the high-accuracy frequency standard and storing accumulated error.

10 Claims, 9 Drawing Figures

TIME-OF-DAY CLOCK HAVING A TEMPERATURE COMPENSATED LOW POWER FREQUENCY SOURCE

The invention described herein was made in the course of or under a contract with the Department of the Air Force.

BACKGROUND OF THE INVENTION

The present invention relates to horology, and, more particularly, to an electronic real-time clock having a low-power source with temperature compensation, real-time calibration, and error accumulation.

Electronic devices operating in a real-time environment often require accurate time-of-day clocks. A navigation or position-determining system which transmits accurately timed signals from a source or sources of known position such as earth-orbiting satellites to a user device having an indeterminate location, requires the use of an accurate time-of-day clock in the user device. An accurate clock in the user device is essential in such systems because an error therein relative to a system time reference standard can introduce unacceptable errors in the measurement of range from the transmitting source.

Oscillators which use a piezoelectric crystal for a frequency standard are known to be highly accurate but sensitive to changes in temperature. As the characteristic frequency of a piezoelectric crystal increases, e.g., to the mega-Hertz range, temperature stability increases; however, such high-frequency crystals are often large and not conducive to circuit miniaturization. It is further desirable in such systems that user devices which are movable, portable, or require storage for relatively long periods (months) consume minimal power. A user device having an extremely accurate, continuously powered time-reference generator, e.g., a crystal oscillator in a constant temperature vessel, as a sole time source may be impractical where portability and/or long term storage are desired. Moreover, electronic circuits controlled by high-frequency time sources operate at commensurably high switching speeds, thereby consuming excessive power in a portable device of the type, for example, having battery power. Present oscillator design constraints require that power consumption increase with increasing temperature stability; power consumption also increases with increasing pulse resolution. Accuracy and low power consumption are thus desirable but incongruous characteristics of portable electronic time pieces at the current state of the art.

SUMMARY OF THE INVENTION

The present invention addresses the aforementioned problems by providing in a portable device an electronic time-of-day clock having a first source of timing signals powered from a low-power source and compensation circuits selectively responsive to the first timing signals when system primary power is off or disabled, and responsive to a second timing signal having a higher frequency and a higher degree of accuracy generated when primary power is enabled. The time-of-day clock compensates the output of the low-power source of timing signals in real-time for errors caused by variations in the ambient temperature of the device as determined by a temperature-sensitive oscillator and the known temperature response of the low-power source of timing signals. When primary power is enabled, the output of the low-power timing signal source is further compensated by comparing the output thereof with the output of the high-accuracy frequency standard and storing accumulated error in a store accessible by the user device. When primary power is enabled, the temperature response characteristics of the low-power source of timing signals is periodically calibrated.

BRIEF DESCRIPTION OF THE DRAWINGS

The invention is pointed out with particularity in the appended claims; however, specific objects, features, and advantages of the invention will become more apparent and the invention will best be understood by referring to the following description of the preferred embodiment in conjunction with the accompanying drawings, in which:

DESCRIPTION OF THE PREFERRED EMBODIMENT

Figure 1:
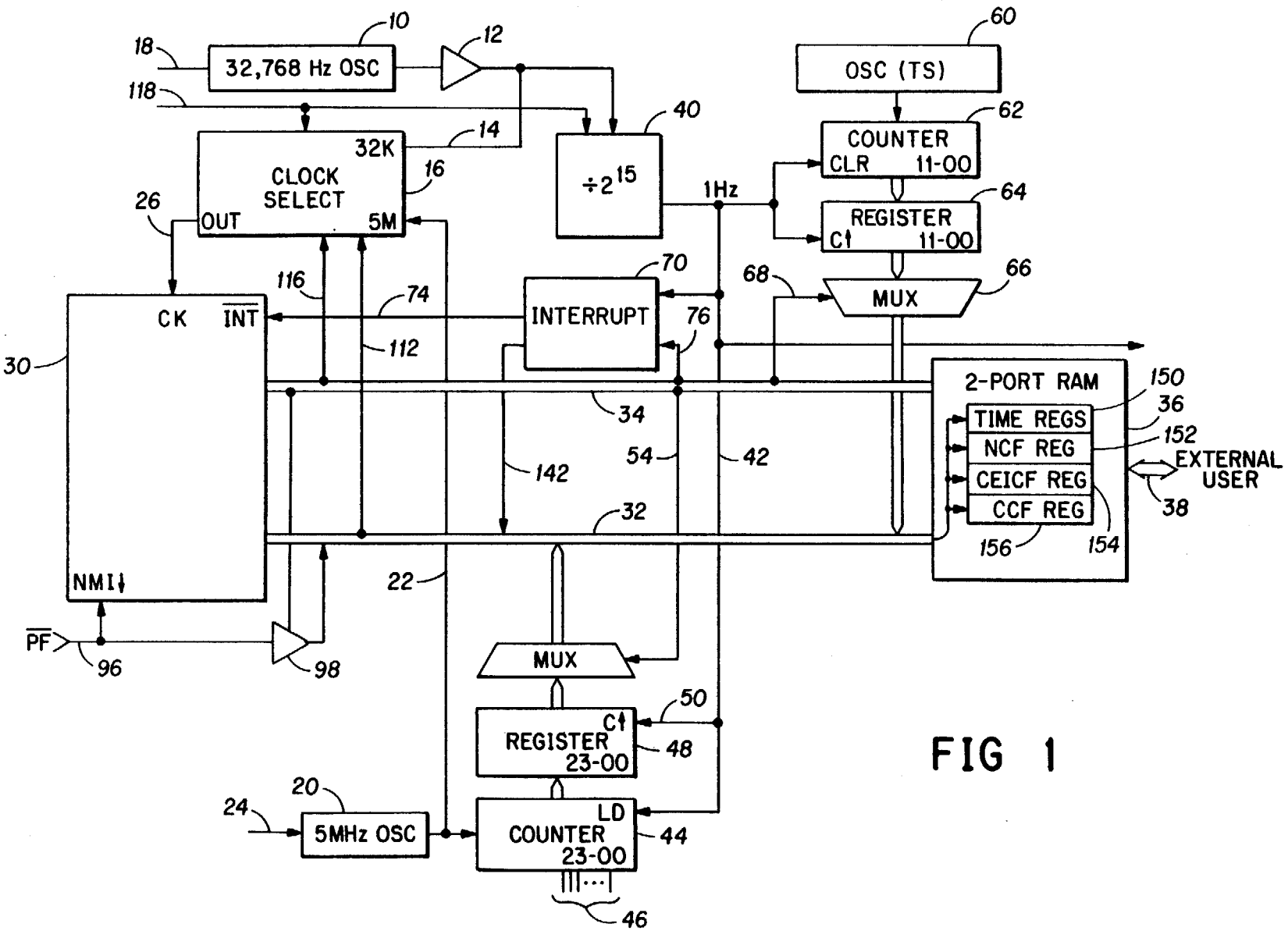
FIG. 1 is a schematic block diagram of a time-of-day clock in accordance with the present invention.
Figure 2:
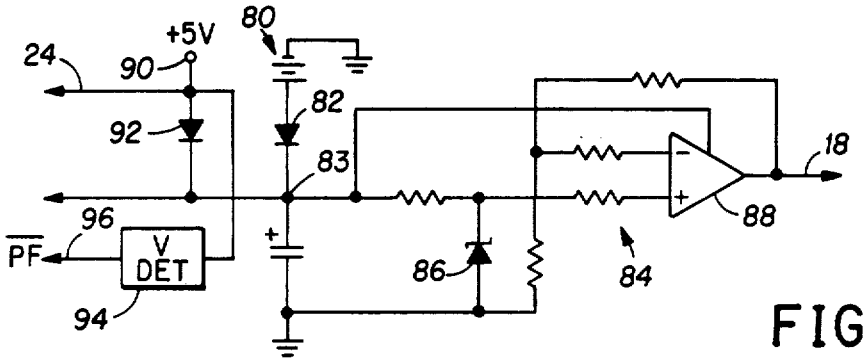
FIG. 2 is a schematic diagram of a power supply circuit utilized with the present invention.

Referring now to the various views of the drawing for a more detailed description of the components, construction, operation and other features of the invention by characters of reference, FIG. 1 shows a schematic block diagram of one embodiment of the invention wherein an oscillator 10 generates a 32,768 Hz clock signal which is coupled via a level converter circuit 12 and a connection 14 to a clock select circuit 16. The 32 KHz oscillator 10 receives regulated +3 volts DC power via a connection 18 from a low voltage power source (FIG. 2). A second source of clock signals 20 comprising a 5 MHz crystal controlled oscillator generates a 5 MHz clock signal which is coupled via a connection 22 to the clock select circuit 16. The 5 MHz oscillator 20 receives regulated +5 volts DC power via a connection 24 from a system primary power source. A clock signal regenerated by the clock select circuit 16 is coupled via a connection 26 to a CK clock input terminal of a microprocessor 30. An external bidirectional data bus 32 and an external address and control bus 34 interconnect the microprocessor 30 with a two-port random access memory (RAM), as well as with other components of the microcomputer embodiment of the instant invention shown in FIG. 1. The two-port RAM 36 is connected to an external user via a bus 38, the external user device being capable of accepting time signal outputs of the time-of-day clock. The external user device may be any apparatus operating in a real-time environment such as navigation equipment, a data logger, or data processing systems wherein an accurate time-of-day clock is required. Otherwise, the external user device may be any apparatus not requiring measurement of time for its operation and wherein the time-of-day clock provides a peripheral function of generating time-of-day for display. It is understood that in the presently-described embodiment of the invention the microprocessor 30 is utilized to perform tasks not associated with operation of the time-of-day clock. Further, communication between the microprocessor and the external user device may be effected through means other than via the two-port RAM, e.g., a serial interface, an input-output processor, a parallel common bus, etc. The microprocessor 30 of the presently-described embodiment of the invention is preferably a low-power CMOS LSI module, as for example an MC146805 microprocessor manufactured by Motorola, Inc.

Clock signals from the 32 KHz oscillator 10 are coupled to a divide-by-$2^{15}$ divider circuit 40, which generates a clock signal having a nominal frequency of 1 Hz on a bus 42. The 5 MHz clock signal from the clock signal source 20 is coupled to a 24-bit counter 44. The counter 44 is loaded with a predetermined binary count of $5\times10^6$ via input connections 46, with each occurrence of the 1 Hz clock signal on the bus 42. The counter 44 counts down continuously in response to the 5 MHz clock signal during each period of the 1 Hz clock signal; the number remaining in the counter 44 at the occurrence of the next subsequent 1 Hz clock signal is enabled into a 24-bit holding register 48 by the 1 Hz clock signal on an input connection 50 of the register 48. A signal multiplexer (MUX) 52 is enabled by a control signal from the microprocessor 30 on a connection 54 to transfer the contents of the holding register 48 onto the bidirectional data bus 32 for storage and subsequent use in determining correction factors of the time-of-day clock as described hereinafter. A temperature sensitive oscillator 60 generates a clock signal which is counted during successive periods of the 1 Hz timing signal in a 12-bit counter 62, the resultant count being stored in a 12-bit holding register 64. The contents of the 12-bit holding register 64 are enabled onto the bidirectional data bus 32 by a signal multiplexer circuit 66 in response to a control signal from the microprocessor 30 on a connection 68. The 1 Hz timing signal is coupled to an interrupt circuit 70 which generates an interrupt signal responsive thereto on an interrupt bus 74 coupled to the microprocessor 30. The interrupt bus 74 may be connected to interrupt signal generating devices other than the interrupt circuit 74. The microprocessor 30 acknowledges receipt of the interrupt signal from the interrupt circuit 70 by generating a write-strobe signal on a connection 76 via the address and control bus 34.

Referring now to FIG. 2, there is shown a schematic diagram of a power source for the time-of-day clock of the instant invention. A standby or low-power voltage source 80 delivers approximately 3.5 volts DC through a 1N5711 isolation diode 82 to a connection node 83. The low-power voltage source may be, for example, a pair of AA size lithium batteries which are rated for 700 milliampere-hours. The circuits of the instant invention operate on standby power at approximately 100 microamps, resulting in battery life of about nine months. A voltage regulator circuit 84 comprising a low-power reference zener diode 86 (LM185) and a CMOS operational amplifier 88 (ICL7611 or equivalent) supplies regulated +3 volts DC on the connection 18 for operating the 32 KHz oscillator 10, the microprocessor 30, and other circuit elements required for standby operation.

A system primary power source (not shown) delivers +5 volts DC via a terminal 90 through a 1N5711 isolation diode 92 to the node 83, supplying power for all non-volatile standby circuits in the equipment. A voltage detection circuit 94 connected to the terminal 90 generates a signal $\overline{PF}$ on a connection 96, when the +5 volt DC primary power is present on the terminal 90. When the +5 V power is turned off or fails, the $\overline{PF}$ signal on the connection 96, see FIG. 1, is disabled at an NMI nonmaskable interrupt input of the microprocessor 30. The microprocessor 30 enables the $\overline{PF}$ signal onto the bidirectional data bus 32 via a three-state buffer 98 for use as described hereinafter.

Figure 3:
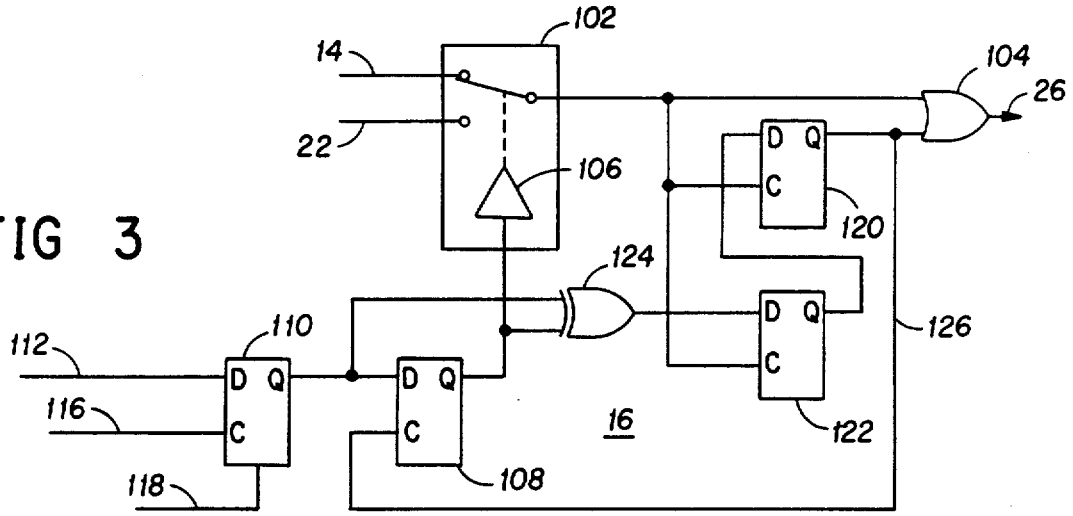
FIG. 3 is a logic diagram of the clock select circuit of FIG. 1.

A detailed diagram of the clock-select logic 16 of FIG. 1 is shown in FIG. 3 to which reference is now made in conjunction with FIG. 1. An analog switch 102 receives the 32 KHz clock signal on the connection 14 and the 5 MHz clock signal on the connection 22. The analog switch 102 is shown in an enabled state, the 32 KHz clock signal being regenerated on the output connection 26 of an OR logic element 104. A switching element 106 of the analog switch 102 is controlled by a switching bistable 108, which in turn is controlled by an input bistable 110. The bistable 110 is conditioned for enabling or disabling by a signal on a connection 112 from the bidirectional data bus 32, and clocked by a write-strobe input signal on a connection 116 from the microprocessor 30 via the address and control bus 34. A power-on clear signal on a connection 118 initially resets the bistable 110. The input signal on connection 112 to the bistable 110 is enabling or high when the 32 KHz clock is selected by the microprocessor 30, and disabling or low when the 5 MHz clock is selected. The signal 112 is representative of the state of the $\overline{PF}$ signal enabled onto the bidirectional data bus by the microprocessor 30. Bistables 120, 122, and an exclusive OR logic element 124 form a clock deglitch circuit. The enabling output of the bistable 120 on connection 126 clocks the switching bistable 108 and also holds the output clock signal on connection 26 high during the transition of the switch 102 from one position to the other, the disabling output of the exclusive OR logic element 124 serving to disable, in turn, the bistable 122 and the bistable 120 to complete the transition of the output clock signal from one to the other. When the 32 KHz clock signal is selected, the microprocessor 30 operates at a greatly reduced speed, and accordingly, functions or tasks not associated with operation of the time-of-day clock are disabled. The microprocessor 30 operating from battery power at reduced speed to generate signals representing time-of-day is termed a low-power time source (LPTS).

Figure 4:
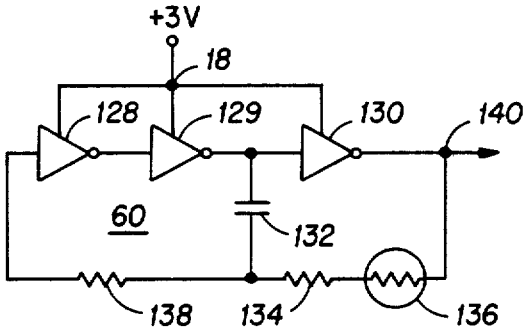
FIG. 4 is a schematic diagram of a temperature sensing oscillator in accordance with the present invention.

The temperature sensitive oscillator 60 of FIG. 1 is shown in greater detail in FIG. 4 to which reference is now made in conjunction with FIG. 1. Three inverting gates 128, 129, 130 of a CD4069B CMOS integrated circuit module are connected as shown in series and powered by the +3 VDC source. A capacitor 132 having a capacitance of 4700 picofarads is connected from a terminal between the inverters 129, 130 to a connection between a 147 K ohm metal-film resistor 134 in series with a 100 K ohm thermistor 136, and a 301 K ohm metal film resistor 138. The thermistor 136 is connected to an output connection 140; the resistor 138 is connected to the input of the inverter 128. The circuit 60 exhibits power dissipation below 70 microwatts maximum, with 50 microwatts average. The nominal frequency of the output clock signal on the connection 140 is 500 Hz.

Figure 5:
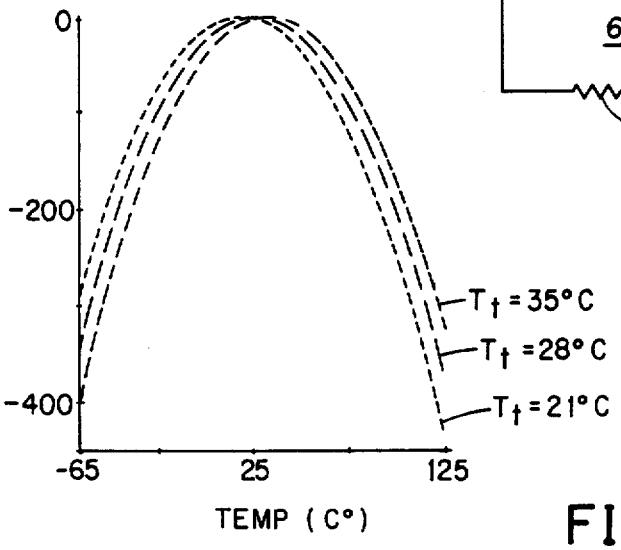
FIG. 5 is a diagram of frequency variation with temperature of a typical watch crystal; and FIGS. *6a–6d* are a flow diagram of operations performed by the FIG. 1 embodiment of the invention.

The time-of-day clock of the instant invention is a time- and temperature-compensated device wherein the microprocessor 30 in concert with the temperature-sensitive oscillator 60 serve as a means for compensating errors inherent in the 32 KHz oscillator 10 regardless of the ambient temperature. The frequency of the clock signal output from the oscillator 10 is controlled by a 32,768 Hz watch crystal having a characteristic frequency variation which is parabolic, typically from −270 parts per million (PPM) at −57° C., near zero at 28° C., and −90 PPM at +71° C. as shown in FIG. 5. For any given watch crystal, the frequency errors are very consistent and change smoothly with temperature as shown in FIG. 5 which illustrates the frequency variation (shown on the ordinate in PPM) with temperature for a typical 32,768 Hz watch crystal having a turning-point temperature $T_t$ of 28°±7° C. Frequency variation is expressed as $\Delta f/f = -K\ (T_t - T)^2$, where $\Delta f/f$ is the frequency variation with temperature in PPM, K is a parabolic curve constant (typically 0.040), $T_t$ is the turning point temperature or the point of zero temperature coefficient, and T is the point of temperature comparison. A plurality of constants representing the temperature characteristics of the 32,768 Hz watch crystal may be stored in the internal RAM of the microprocessor 30. The microprocessor 30 normally operates in an interrupt driven, multiprogramming mode, periodically incrementing time registers 150 in the two-port RAM 36 in response to the interrupt signal derived from the 32 KHz oscillator. The time registers 150 typically hold data representing time-of-day which is defined herein but not limited to the year, month, day of the week, date, hour, minute, second, and fractions of seconds. Periodically, the microprocessor 30 determines ambient temperature of the equipment by reading the frequency of the temperature sensitive oscillator 60. After determining the temperature, the microprocessor 30 determines the nominal frequency of the oscillator for the instantaneous temperature, the effect of temperature on the 32,768 Hz crystal being known and stored in the microprocessor 30 RAM. The temperature compensation curve is approximated in the instant embodiment with a polynomial least-squares fit, the affected components varying smoothly with temperature. The polynomial approximation allows accurate interpolation between known points and is very memory efficient compared with a ROM look-up table.

Other factors such as crystal aging, aging of other circuit components, vibration and shock, may effect long-term accuracy of the LPTS. Factory and periodic field calibration of time-of-day clock circuits is not easily done as a manual operation. There is a temptation to purchase expensive components having close initial tolerances, thus obviating the need for calibration, even though degraded accuracy may result. The present invention, however, is capable of automatic self-calibration using an extremely accurate internal frequency standard, the 5 MHz oscillator 20, whenever the equipment primary power is turned on and the temperature stabilized. The polynomial coefficients stored in the internal microprocessor 30 RAM are periodically updated providing continuous recalibration of the LPTS and compensation for component aging. Such continuous recalibration is especially efficacious when the operating and storage temperature ranges overlap significantly.

Figures 6A, 6B:
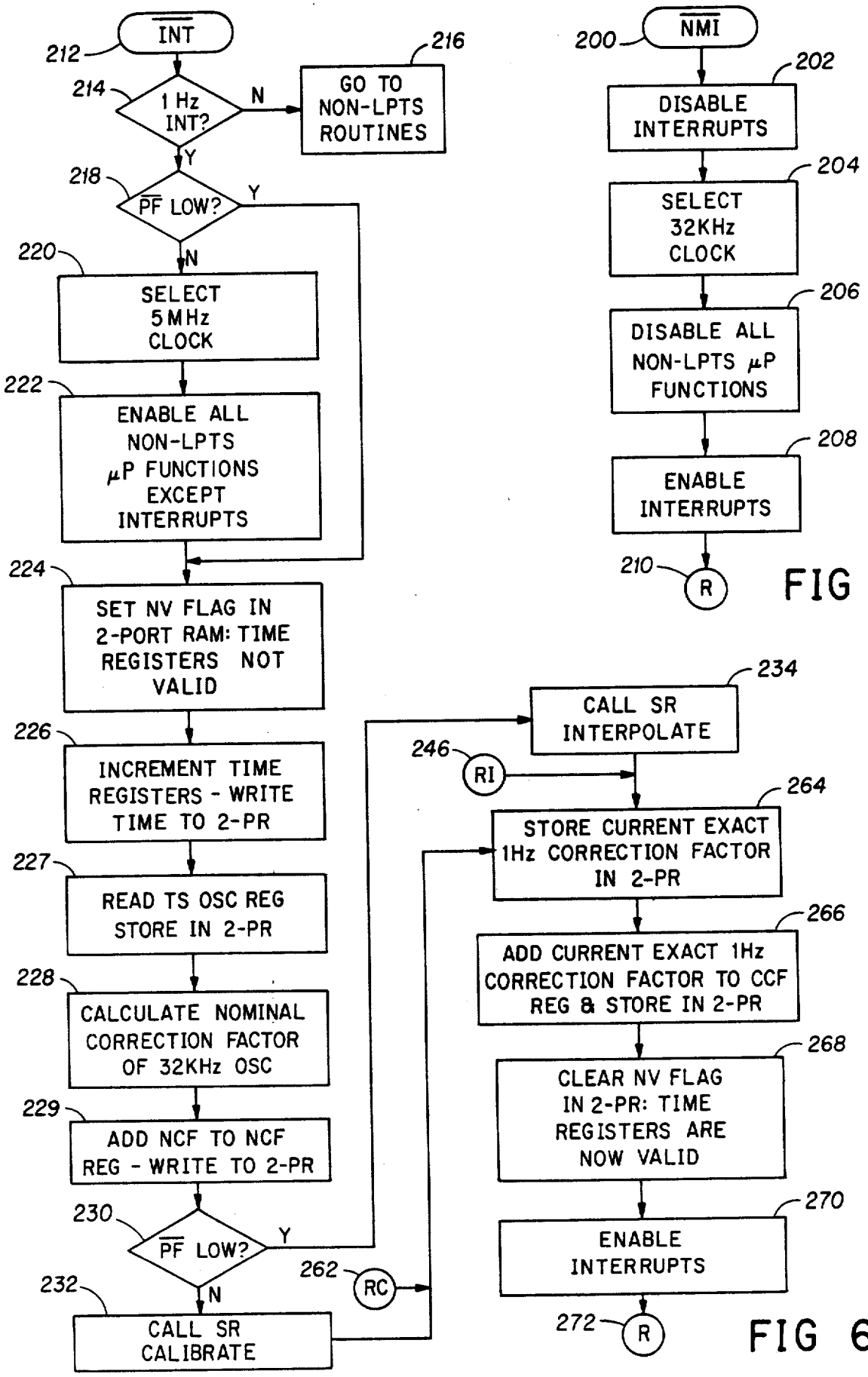

FIG. 6, to which reference is now made in conjunction with FIG. 1, shows a flow diagram of the operation of the time-of-day clock of the present invention. Referring to FIG. 6*a*, the $\overline{PF}$ signal disabled on the connection 96, signifying loss of primary power, initiates a non-maskable interrupt NMI, reference number 200. A non-maskable interrupt means an input interrupt signal the processing of which cannot be ignored or deferred by the microprocessor, as for example, in response to a programmed input such as an apertured mask. In response to the $\overline{PF}$ signal disabled, the microprocessor 30 disables interrupts 202, i.e., the recognition thereof, and selects the 32 KHz clock signal, block 204. To select the 32 KHz clock, the microprocessor 30 generates an enabling signal via the bidirectional data bus 32 on the connection 112, and a strobe signal via the address and control bus 34 on the connection 116 as previously described with reference to FIG. 2. After selecting the 32 KHz clock, the microprocessor 30 disables all non-LPTS functions 206, enables interrupts 208, and returns to the previously-executing task 210. A sufficient number of 5 MHz clock signals are generated after the $\overline{PF}$ signal is disabled to allow the microprocessor to select the 32 KHz clock signal.

Referring to FIG. 6*b*, upon the occurrence of an enabling signal at the interrupt input terminal INT 212, the microprocessor, as represented by decision block 214, determines whether or not the interrupt signal was issued by the 1 Hz interrupt circuit 70. The determination is made by testing for the presence of a signal enabled onto the bidirectional data bus 32 from the interrupt circuit 70 via a connection 142. If the interrupt was not a 1 Hz interrupt, the program branches to block 216; however, when the 32 KHz clock is selected, non-LPTS functions are not performed and the microprocessor enters a wait loop. If the interrupt was a 1 Hz interrupt, the program proceeds to decision block 218, where the state of the $\overline{PF}$ signal is determined. If the $\overline{PF}$ signal is enabled or high, indicating the presence of primary power, the microprocessor 30 selects the 5 MHz clock, as represented by block 220, and enables all non-LPTS functions except interrupts, block 222. If the $\overline{PF}$ signal is low, indicating the absence of primary power, blocks 220 and 222 are skipped and the microprocessor sets an NV flag in the two-port RAM, indicating to the external user that the time registers 150 are not valid while being updated by the microprocessor. In block 226, the time registers 150 in the two-port RAM are updated, and the program proceeds to block 227. The microprocessor 30 enables the contents of the register 64 onto the bidirectional data bus, thereby reading the frequency of the temperature-sensitive oscillator 60. In addition to placing the contents of the register 64 into the internal registers of the microprocessor 30, the count is stored also in the two-port RAM to allow access by the external user if desired. Proceeding to block 228, the microprocessor, assuming nominal value circuit components (such as a crystal having $T_t$=28° C.), then calculates an initial nominal correction factor of the 32 KHz oscillator based on the known (stored) frequency vs. temperature characteristics of the crystal and the temperature previously read (block 227). The nominal correction factor is added to an NCF register 152 in the two-port RAM block 229. This nominal value can be utilized subsequently to bound anomalous "exact correction factor" data that might occasionally occur. In decision block 230, the microprocessor again tests for the presence of system power. If system power is on ($\overline{PF}$ signal enabled), the NO branch is enabled, block 232, and the CALIBRATE subroutine is called. If system power is off ($\overline{PF}$ signal disabled), the YES branch from decision block 230 is taken to block 234 and the INTERPOLATE subroutine is called.

Figure 6C:
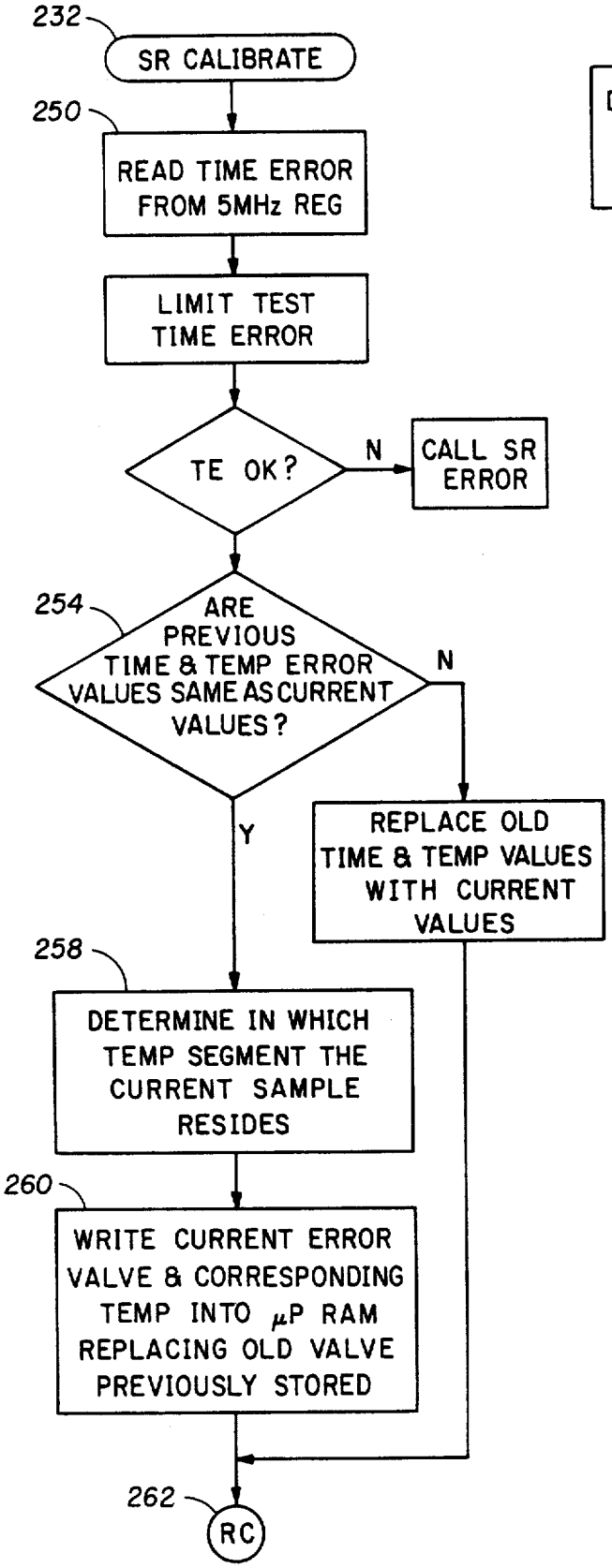
Figure 6D:
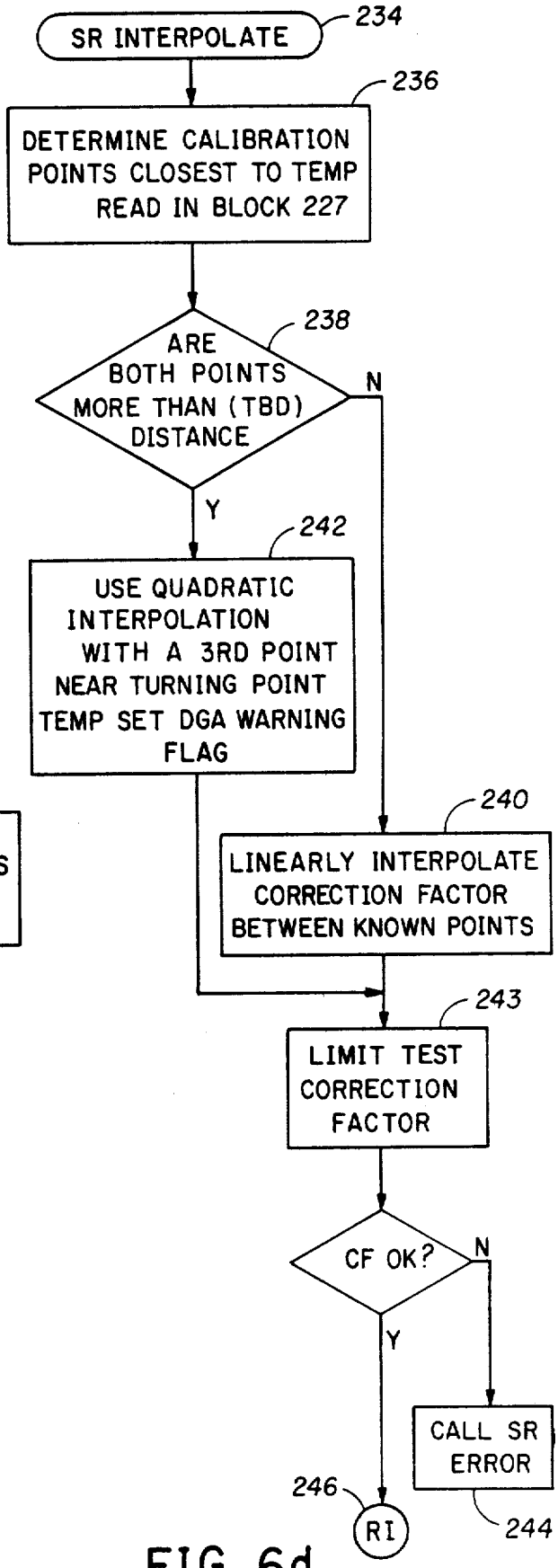

Referring now to FIG. 6*d*, in the INTERPOLATE subroutine, block 236, the microprocessor selects two calibration points closest to the temperature read in block 227, and in decision block 238 determines whether or not both points represent a distance greater than the distance to be determined, i.e., if the presently-held exact correction factor data relates closely enough to the current known temperature. For example, if all the exact correction factor data is for temperatures near +70° C., then linear interpolation of this limited data to, say, −55° C., would be clearly erroneous. The decision in block 238 to use linear interpolation or not also depends on the proximity of the measured temperature to the $T_f$ of the crystal, where the rate of change of the slope of the crystal characteristic curve is the greatest. If the NO branch is taken from block 240, the microprocessor linearly interpolates an exact correction factor between the known data points; alternatively, in block 242, the microprocessor uses quadratic interpolation with a third point nearer the turning point temperature to generate an exact correction factor. Concurrently, in block 242, the microprocessor enables a DGA warning flag in the two-port RAM to warn the external user of degraded accuracy (copies of such data may be stored in the internal RAM of the microprocessor 30 for communication to the external user device by alternate paths than the two-port RAM). After generating the exact correction factor, the microprocessor limit tests the exact correction factor (block 243) and branches to an ERROR subroutine 244 if predetermined limits based in part on the nominal correction factor calculated in block 228 are exceeded, and otherwise returns to the INTERRUPT subroutine, reference numeral 246, FIG. 6*b*. Referring now to FIG. 6*c*, in the CALIBRATE subroutine, which is called only if system power is on, the microprocessor first reads the time error derived from the 5 MHz oscillator 20 clock signals and stored in the 24-bit holding register 48, limit tests the time error quantity, and then determines (block 254) if previously-stored time and temperature error values correlate with the current values, i.e., if long term drift has occurred. If not (block 256) the old time and temperature values are replaced with the current values. If the previously-used time and temperature error values correlate with the current values, then a determination of the temperature segment in which the current sample resides is made (block 258). In block 260, the current error value and its corresponding temperature are stored in the microprocessor RAM, replacing the old value previously stored in those memory locations, and thus the predicted time error versus temperature curve for the clock is automatically updated. The program then returns 262 to the INTERRUPT subroutine. Upon returning to the INTERRUPT subroutine 264, from either the INTERPOLATE subroutine 246 or the CALIBRATE subroutine 262, the microprocessor stores the current exact 1 Hz correction factor in a CE1CF register 154 in the two-port RAM 36. The CE1CF data item generated during performance of the CALIBRATE subroutine is of course more accurate than that generated during the INTERPOLATE subroutine, the former being a measure of the clock circuit time error relative to a highly-accurate frequency standard such as the 5 MHz oscillator 20. In block 266, the CE1CF data item is added to a CCF cumulative correction factor register in the two-port RAM, the NV flag is cleared, (block 268) indicating that the time registers are valid, and interrupts are enabled (block 270) as the microprocessor exits the INTERRUPT subroutine 272 returning to the interrupted task. The external user may access the time registers 150 in the two-port RAM, and additionally obtain accumulated correction data and an indication of accuracy degradation if system primary power has been off.

While the principles of the invention have been made clear in an illustrative embodiment, there will be immediately obvious to those skilled in the art many modifications of structure, arrangement, proportions, the elements, material and components, used in the practice of the invention and otherwise, which are particularly adapted for specific environments and operating requirements without departing from those principles. The appended claims are therefore intended to cover and embrace any such modifications, within the limits only of the true spirit and scope of the invention.

What is claimed is:

1. Electronic apparatus including a time-of-day clock, said apparatus comprising:

primary means for supplying operating power to said apparatus;

secondary means for supplying power to said time-of-day clock;

means powered by said secondary power supply means for generating a first clock signal;

means coupled to said first clock signal generating means for generating indicia representing a period of time;

means powered by said primary power supply means for generating a second clock signal having a frequency and accuracy at least one order higher than the first clock signal; and microprocessor means powered by said secondary power supply means and responsive to the indicia for generating data items representing time-of-day, said microprocesor means being clocked by the first clock signal when said primary power supply is disabled and by the second clock signal when said primary power supply is enabled.

2. The apparatus as claimed in claim 1, comprising: means coupled to said second clock signal generating means and repsonsive to the indicia for counting the second clock signal during the period of time, said microprocessor means including means responsive to the indicia and to said counting means when said primary power supply is enabled for compensating inaccuracy of the period of time derived from the first clock signal.

3. The apparatus as claimed in claim 1, comprising: means powered by said secondary power supply means and coupled to said microprocessor means for sensing ambient temperature of said first clock signal generating means, said microprocessor means including means for storing predetermined data items representing frequency versus temperature characteristics of said first clock signal generating means, said microprocessor means including means responsive to the indicia and the ambient temperature sensed by said sensing means for compensating inaccuracy of the time period caused by changes in ambient temperature of said first clock generating means.

4. The apparatus as claimed in claim 3, comprising: means coupled to said second clock signal generating means and repsonsive to the indicia for counting the second clock signal during the period of time, said microprocessor means including means responsive to the indicia and to said counting means when said primary power supply is enabled for compensating inaccuracy of the period of time derived from the first clock signal.

5. Apparatus as claimed in claim 3, wherein said microprocessor means includes means operating when said primary power supply means is enabled for periodically calibrating the predetermined data items against the second clock signal.

6. Electronic apparatus including a time-of-day clock, said apparatus comprising:

primary means for supplying operating power to said apparatus;

means for detecting a low output condition of said primary power supply means;

secondary means for supplying operating power to said time-of day clock;

means connected to said secondary power supply means for generating a first clock signal;

means connected to said secondary power supply means for sensing ambient temperature of said first clock signal generating means, said sensing means including means for generating a data item representing the ambient temperature;

means responsive to said first clock signal generating means for generating indicia representative of a period of time;

means connected to said primary power supply means for generating a second clock signal having a frequency and accuracy at least one order higher than the first clock signal;

microprocessor means connected to said secondary power supply means for compensating inaccuracy of the time period, said microprocessor means being operative responsive to an externally generated clock signal, said microprocessor means having means responsive to said indicia for storing signals representing time-of-day, means for storing data items representing frequency versus temperature operating characteristics of said first clock signal generating means, means further responsive to said indicia for receiving the ambient temperature data item and generating a time error signal derived from the operating characteristics data items;

means coupled to said first and said second clock signal generating means and to said microprocessor means for selecting the second clock signal as the externally generated clock signal operating said microprocessor means when said primary power supply means is enabled, said selecting means being responsive to said detecting means for selecting the first clock signal as the externally generated clock signal operating said microprocessor means; and means for storing an accumulation of the time error signals.

7. Apparatus as claimed in claim 6, comprising:

means operable when said microprocessor means is operating responsive to the second clock signals for calibrating the temperature response characteristic of said first clock signal generating means.

8. Electronic apparatus including a time-of-day clock, said apparatus comprising:

primary means for supplying operating power to said apparatus;

means for detecting a low output of said primary power supply means;

secondary means for supplying operating power to said time-of-day clock;

means connected to said secondary power supply means for generating a first clock signal;

means coupled to said first clock signal generating means for generating indicia representing a period of time;

means connected to said secondary power supply means for sensing ambient temperature of said first clock signal generating means;

means connected to said secondary power supply means for controlling said time-of-day clock, said control means being operative responsive to a clock signal generated externally of said control means, said control means being capable of operating in a secondary power mode to perform only time-of-day clock functions and a primary power mode to perform control functions in addition to the time-of-day clock functions, said control means including means for storing a plurality of data items including data items representing frequency versus temperature operating characteristics of said first clock signal generating means, data items received from said sensing means representing the ambient temperature of said first clock signal generating means, and data items representing time-of-day, the time-of-day data items including an accumulation of correction data items generated periodically by said control means from the ambient temperature data items and the data items representing frequency versus temperature operating characteristics of said first clock signal generating means;

means connected to said primary power supply means for generating a second clock signal having a frequency and accuracy at least one order higher than the first clock signal; and means coupled to said first and said second clock signal generating means and to said control means for selecting the second clock signal as the externally generated clock signal operating said control means in the primary power mode when said primary power supply means is enabled, said selecting means being responsive to said detecting means for selecting the first clock signal as the externally generated clock signal operating said control means in the secondary power mode.

9. Apparatus as claimed in claim 8, wherein said control means includes means operative in said primary power mode for calibrating the frequency versus temperature operating characteristics data items stored therein.

10. Apparatus as claimed in claim 8, wherein said control means includes means operative in said primary power mode for generating correction data items representing the difference in accuracy between said first and said second clock signal generating means.

* * * * *